US005302227A

United States Patent [19]

Dalrymple et al.

[11] Patent Number: 5,302,227

[45] Date of Patent: Apr. 12, 1994

[54] METHOD FOR CLOSING A HEAT-RESISTANT CARTON

[75] Inventors: Bruce H. Dalrymple, Loganville; Charles R. Landrum, Dunwoody; Randall L. Stauffer, Lithia Springs, all of Ga.

[73] Assignee: Kliklok Corporation, Decatur, Ga.

[21] Appl. No.: 855,519

[22] Filed: Mar. 20, 1992

[51] Int. Cl.[5] ..... B32B 31/12; B31B 1/44; B65B 51/00

[52] U.S. Cl. ..... 156/443; 156/69; 156/204; 156/227; 493/80; 493/168; 53/374.3; 53/375.4; 53/376.5; 53/476

[58] Field of Search ..... 53/374, 476, 375, 376, 53/377, 387.2; 156/69, 204, 226, 227, 443; 493/80, 168, 167, 245

[56] References Cited

U.S. PATENT DOCUMENTS

| | | | |
|---|---|---|---|
| 410,522 | 9/1889 | Jaeger | 493/167 X |
| 2,639,649 | 5/1953 | Silby | 493/168 |
| 3,443,353 | 5/1969 | DiVecchio | 53/484 X |
| 3,562,920 | 2/1971 | Vuilleumier et al. | 34/48 X |
| 3,738,082 | 6/1973 | Anderson | 53/329.4 X |
| 3,780,493 | 12/1973 | Baker | 53/287 X |
| 3,851,445 | 12/1974 | Schuh | 253/329 X |
| 4,249,978 | 2/1981 | Baker | 156/291 X |
| 4,304,352 | 12/1981 | Humphries | 229/163 X |
| 4,417,882 | 11/1983 | Wallin | 493/174 |
| 4,435,943 | 3/1984 | Hoyrup | 53/491 X |
| 4,559,092 | 12/1985 | Oakley | 156/69 |
| 4,626,234 | 12/1986 | Oxborrow | 493/134 |
| 4,636,187 | 1/1987 | Oakley | 493/134 X |
| 4,735,665 | 4/1988 | Miyauchi | 156/69 X |
| 4,969,306 | 11/1990 | Wallin | 53/329 X |

FOREIGN PATENT DOCUMENTS

| | | | |
|---|---|---|---|
| 2073698 | 10/1981 | United Kingdom | 493/168 |

*Primary Examiner*—David A. Simmons
*Assistant Examiner*—Charles Rainwater
*Attorney, Agent, or Firm*—King and Schickli

[57] ABSTRACT

A closing method for a multi-sided paperboard carton includes sealing a cover with side edge extensions to corresponding side flanges defined by fold lines on the paperboard carton during continuous feeding of the carton along the feed path. The side flanges of the carton body are bent downward during continuous feed movement with a force sufficient to cause the flanges to fold and remain free and below a plane passing through the fold line when released. The cover is placed on the carton to lie substantially in a plane and with the edge extensions overlying the flanges. A hot air stream is directed into the half-V gap presented between each flange and associated cover side edge extension to activate an adhesive coating and the flanges are pressed against the cover for sealing. The carton is carried through the bending stage in a die having an open bottom cavity and forming blades on its side edges that engage the fold line between the side flanges and the carton side panels from below. Platen members are presented for engagement with the blade edges of the die to bend and squeeze the flanges to create the downwardly bent orientation and facilitate sealing during continuous movement. The side flanges may be prebroken and preheated to facilitate the bending and sealing operations downstream.

22 Claims, 8 Drawing Sheets

FORM CARTON
STRIP FROM PLUNGER & FEED ALONG PATH
DRIVE MEANS
HEAT
HEAT
A
B
F
P
P
10
12
14
14
16
18
18
20
20
22
22
22
24
24
26
26
28
28
30
30
32
34
36
38

ROTARY DRIVE
ROTARY DRIVE
PLOW BACK COVER
FULLY SEAT CARTON
TUCK CARTON INTO TRAVELING DIE

HOLD DOWN LEADING FLANGE & PREBREAK TRAILING FLANGE

BEND FLANGES SUFFICIENTLY TO HOLD BELOW HORIZONTAL

PREBREAK LEADING FLANGE

APPLY SUPPLEMENTAL HEAT

ALTERNATE EMBODIMENT

15°
120°
165°
40°
60°

METHOD FOR CLOSING A HEAT-RESISTANT CARTON

TECHNICAL FIELD

The present invention relates to the field of heat resistant paperboard cartons and, more particularly, to an improved method and apparatus for closing a heat-resistant carton where the cover of the carton can be rapidly sealed and good seal integrity is provided.

BACKGROUND OF THE INVENTION

Many types of containers and cartons formed from folded paperboard are in widespread use today in the food industry. For packaging food items, such as frozen foods, one widespread practice is to form a multi-sided carton from plastic coated paperboard, fill the carton on a continuous food processing line and then to seal the carton closure flaps and/or flanges by automatic machinery. In the past, this closing function is most often accomplished by hot air activation of the plastic coating and then pressing the flaps and flanges against the side panels of the carton.

The use of thermosetting coatings, such as polyester resin or other heat resistant materials, is desirable since a carton of this type is safe to use for packaged foods, and can be placed directly in a microwave for cooking or reheating. These coatings also provide superior barrier qualities for preventing the paperboard from absorbing juices and/or grease during cooking. Many of these packaged foods are cooked while covered or semi-covered, so as to retain maximum moisture, flavor and aroma, as well as to prevent food splatter in the oven. Cooking or reheating packaged foods in a conventional oven where the temperature often exceeds 270° C. (425° F.) is a big advantage for these coated cartons.

Heat activated polyester resin can also be used as the adhesive for sealing two coated surfaces together, as with the other plastics. However, in practice the sealing process is more difficult than with the other most popular plastics, such as polyethylene resin. In fact, others have had only limited success in using the activated polyester film for closing cartons. This is where on the single-sided (inside) coated paperboard, the side edge extensions of the cover are sealed to the corresponding outwardly folded side flanges of the carton body. In past practice, the cover is either a hinged panel on the carton, or a separate lid merged with the carton just prior to the closing operation.

To provide the requisite adhesive properties or tackiness to the polyester resin, it must be heated to a temperature in the range of 225° to 550° F., and then firm pressure promptly applied to bond the surfaces together. The key advantage of this type of seal made with polyester resin is that good seal integrity is maintained at the elevated temperatures, for example, up to 230° C. or 450° F. High quality seals between the side extensions on the cover and the side flanges on the body of the carton can be attained so long as sufficient hot air can be blown against the coated surfaces, and sufficient time is available for pressing the surfaces together and cooling the film.

Experience teaches that the most important parameter in fulfilling these requirements is the careful control of the heating of the surfaces to be sealed. Since the temperature required for bringing the polyester resin to a tackiness where it can be used as an adhesive is relatively high, high speed operation usually must be sacrificed. Indeed, in many prior art approaches, the closing process must be intermittent, rather than continuous, as set forth in the Oxborrow U.S. Pat. No. 4,626,234, issued Dec. 2, 1986. In this patent, the four-sided cartons or trays are fed in an intermittent fashion past a fixed heating location; i.e. where hot air is blown against the flanges of the carton and the adjacent edge extensions of the cover or lid. Downstream at another station, the carton is again momentarily stopped to provide the requisite pressure to seal the surfaces together.

Because of the demand of the industry to increase the speed of the packaging process, and to prevent the closing operation from being the bottleneck, numerous attempts have been made to seal the cover or lid to the carton in a continuous, rather than in this intermittent fashion. An approach in this regard that has been attempted in the past for specifically attaching separate flat lids to a tray is shown in the U.S. Pat. No. 4,559,092 to Oakley, issued Dec. 17, 1985. In this approach, the lid is prepositioned on the tray with flanges on the sides of the lid facing the side flanges on the body of the tray. The two juxtaposed flanges are bent away from each other by plows situated along the feed path in order to attempt to form a V-shaped gap. Ideally, the hot air is blown into the open gap of the V, and the polyester resin coating is heated to the temperature necessary for sealing. Practice, however, shows that the narrow side flanges are difficult to open up and keep open in this manner due to the stiffness and inherent memory of the polyester film on the paperboard. This is especially true in the instance where printed material on the carton includes electron beam cured ink. The hard fact is that sufficient heating usually does not take place to provide a good, high integrity seal when these prior art approaches are used.

Also, this type of closing operation is slowed by a substantial degree due to the requirement for mechanical devices, such as the side plows, to remain in constant contact with the flanges. Because of the stiffness of the polyester film and the continuous side plow engagement, it is difficult to control the tracking of the carton along the feed path. The inherent springiness of the flanges acting against stationary plows along the side and other mechanical devices used to attempt to keep the V open, causes lateral shifting of the tray and lid from side to side. This substantially restricts the speed allowed, and due to misalignments adds to the rate of failure of the closing operation.

The prevalent thinking in the industry of providing mechanical devices for holding narrow flanges apart during application of heat for sealing is shown by the Reil et al. U.S. Pat. No. 3,980,515, issued Sep. 14, 1976. The requirement for holding the flanges apart inevitably leads to a stationary, rather than continuous, sealing operation.

Accordingly, improvement in the area of sealing a multi-sided carton or container having the inside coated with heat resistant film is sorely needed. The industry is seeking a way that efficient and reliable closing of a carton with either a hinged or separate cover or lid can be accomplished in a continuous, relatively high speed fashion. It has been proposed that the best way to accomplish this result is to do away with the need for stationary side plows and other holding devices, and to in some other way assure that the two surfaces to be sealed are opened up so as to be able to be subjected to the high temperature, hot air activation in a reliable fashion. To do this, a relatively radical departure from this prior practice is indicated.

It is, therefore, an object of the present invention to provide a method and related apparatus for closing a multi-sided paperboard ovenable carton through sealing of a cover to the side flanges of the body of the carton in such a manner to overcome the shortcomings and limitations of the prior art. The result of the attainment of this objective is a closure seal exhibiting excellent quality adhesive bonding, and high seal integrity that is maintained through freezing, distribution and heating even at the high temperatures found in conventional ovens.

It is another objective of the present invention to provide reliable, hot air adhesive activation for an inside coated carton by forming at least a half-V between the edge extension of the cover and the corresponding side flange of the body of the carton.

It is another and related object of the present invention to provide a method/apparatus that allows continuous adhesive activation between the edge extensions of a cover and the side flanges of the body of a carton by presenting a reliable open gap, at least a half-V, for receiving the hot air stream.

It is still another and related object of the invention to provide a method/apparatus of forming a closed carton without the need for mechanical, stationary plows and/or other devices to hold the gap open, and thereby allow the extensions/flanges to remain free during adhesive activation.

It is still another object of the present invention to provide a system for high speed closing of a carton by sealing a cover to the body of the carton wherein the side flanges of the carton are bent downwardly during feed movement with sufficient force to overcome the natural stiffness and memory of the plastic coating, thus allowing the flange to remain free and below a plane passing through the fold lines of the flanges for a time sufficient to provide the adhesive activation.

It is still another object of the present invention to provide the sealing method and related apparatus that allows the carton to be moved along a continuous feed path from the standard forming machine through a flange bending station, a product filling station, a sealing/closure station, and finally to the end of the packaging line.

It is another object of the present invention to provide the method and system for sealing a cover to the carton in a simplified, continuous manner wherein a die with an open cavity carries a carton along the feed path, and forming blades on the die mate with platen members to mechanically bend the side flanges of the carton to the degree necessary to assure maintenance of an open half-V allowing hot air to contact the mating board surfaces and providing full adhesive activation.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

BRIEF DESCRIPTION OF THE INVENTION

The above-identified objectives and others that are equally important are obtained in accordance with the present invention through a new and improved method of closing a carton and a related apparatus. In particular, the method and apparatus proposes sealing a cover or lid on an ovenable carton in such a manner that the carton can be fed continuously and at high speed during the closing operation; and thus, a potential bottleneck of the packaging system is eliminated. The multi-sided carton structure itself, that is being formed and closed in accordance with the concepts of the present invention, is similar to the carton set forth in U.S. Pat. No. 4,304,352 to Humphries, issued Dec. 8, 1981, and assigned to the assignee of the present invention. While in some instances cartons are described as having a front, back, sides and/or ends, in the present application reference to the carton structure is simplified by denoting the carton as being multi-sided (preferably four sides).

In accordance with the overall closing method of the present invention, a cover is sealed to an ovenable, paperboard carton utilizing the plastic coating on the inside of the carton. The side edge extensions of the cover overlie the outwardly directed side flanges on the body of the carton that are bent downwardly to form an open gap or space prior to adhesive activation. Feeding the carton along the path prior to bending of the flanges is expedited by its positioning in a cavity of a die. The carton efficiently merges with the cavity of the die at an acute angle of approximately 6–10 degrees. An overhead conveyor having depending fingers is effective for tucking the carton into the cavity by urging the leading bottom corner forward at a speed slightly in excess of the feed speed.

The inventive concept includes bending the flanges downwardly during the continuous movement of the carton in the die with a force sufficient to cause the flanges to fold downwardly and, when released, to remain free and below a plane passing through the fold lines that define the flanges. This key aspect of the method causes the flanges to remain freely bent down at an angle for a sufficient amount of time to allow the adhesive activation, product filling and then placing the cover on the carton. The cover advantageously lies substantially in the plane of the fold lines of the flanges during the step to activate the adhesive in the gap or space provided by the downwardly extending flanges.

Due to the efficiency of the bending step, it is found that the downwardly bent side flanges on the body of the carton provide a sufficiently open gap so that the side extension or flange on the cover can remain substantially horizontal. In essence, the step of activating the adhesive can take place by a hot air stream directed into the half-V gap formed between the flanges and the cover. To complete the closing operation, the flanges are pressed together with the cover for sealing. It will be realized that the highly efficient closing operation of the present invention includes for the first time sealing of the flanges of a carton during the continuous forward feed movement of the carton, and most importantly, while the side flanges remain free during adhesive activation.

In accordance with another important concept of the present invention, the method includes preheating the flanges adjacent the fold lines prior to the bending operation in order to improve foldability. The heat applied during this preheating step is sufficient to raise the surface temperature of the carton adjacent the fold lines to substantially prevent thinning of the polyester film during bending as the film stretches around the fold line. Preferably, the surface temperature during the preheating step is maintained in the range of approximately 100°-250° F.

It has been found that the bending of the flanges is most efficiently carried out by feeding the carton sidewise along the feed path to present leading and trailing upstanding flanges in the direction of travel. The isolation of the flanges in this manner allows for more efficient bending in a continuous motion. Specifically, the flanges are positioned in an open cavity die with forming blades engaging the fold lines from below. Mating platen members, that preferably include V-shaped grooves, are provided above for forcing the flanges downward to squeeze the flange against the sharpened edge of the blades. In accordance with the preferred embodiment, this engagement is carried out by applying a force of between 50014 3,000 pounds, preferably approximately 2,700 pounds, along each fold line of a standard size carton. This advantageously provides the required mechanical bending of the flange in order to remain free and below the referenced plane when released, for subsequent filling at a downstream filling station, and then finally to a position for adhesive activation and preparation for sealing. A full width, rather than the prior art characteristic line seal, is obtained across the side flange of the carton.

In accordance with the apparatus of the present invention, and as briefly mentioned above, a die having an open cavity receives and carries the carton along the feed path with the fold lines of the side flanges aligned with the forming blades. The edges of the blades engage the corresponding fold lines from below, and platen members mounted on an overhead conveyor are brought into position for squeezing the flange and the body of the carton toward each other.

The apparatus includes novel means for providing forced, relative movement of the die and the platen members toward each other to generate the requisite pressure. Advantageously, the pressure provided is sufficient to bend and fold the flanges so that when released, the memory of the paperboard and coating is overcome and the flanges can remain free and be assured of being maintained below a plane passing through the flange fold lines. In other words, the flanges are held down by themselves in a position at an approximate 30-degree angle to the plane passing through the fold line so as to form the open half-V gap. The hot air can efficiently enter the gap and fully activate the adhesive on the flange surface and the opposing edge extension surface of the cover for sealing.

In accordance with still additional aspects of the present invention, the platen member is preferably formed of a plastic block (such as cast nylon), which has the V-shaped groove or recess to receive the folded carton flange/side panel for pressing against the edge of the die for forced bending. The groove is centered, and the apex section engages the fold line during the flange bending operation. An angle of approximately 40 degrees is found to work most efficiently for bending in cooperation with a knife edge of approximately 15 degrees. A lead section of the groove is provided having an included angle of approximately 60 degrees.

Preferably, the platen member is positioned in an elongated carrier extending transversely across the feed path for engaging the leading and trailing flanges of the carton in a synchronous manner. The apex of the V-groove corresponds to the pitch point of the side running chains supporting the transverse carrier. This provides a smooth entrance and exit of the folded flange into and out of the groove, minimizing possible carton jams, and reducing the strain on the component parts of the machinery that might otherwise occur under the force applied by the platen member. The high pressure required to urge the platen member against the die with such a large force is provided by cooperative guide rollers and rails positioned along the feed path.

The platen member is designed to float, such as by being mounted on an elastomeric pad in the carrier and by including side-to-side clearance. This feature provides resilient pressing action, and accommodates any slight misalignment between the platen member and the forming blades during the squeezing action.

Each die is easily replaceable by being preferably releasably mounted on a cradle that forms an integral part of the conveyor along this bending section of the system. Locating means carried on the cradle accurately positions the die and latch means is provided for locking the die in place. The forming blades may even include a removable blade element that is locked in place on the die, thus further minimizing the time and expense connected with replacement.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 3*e* is a side view showing the carton travelling past a stationary overhead guide that operates to hold down the leading side flange and prebreak the trailing side flange;

FIG. 4*a* is a side view schematically showing the application of heat to the side flanges to prepare the film coating of the carton for the bending operation;

FIG. 4*b* is a side view showing the operation of the transverse platen members as they engage and squeeze the leading and trailing side flanges over the forming blades of the die cavity during continuous travel along the feed path;

FIG. 4*c* is a side view showing the lifting and withdrawal of the carton with its downwardly bent side flanges from the cavity of the die for delivery to the filling station;

Figures 1, 2A, 2B:
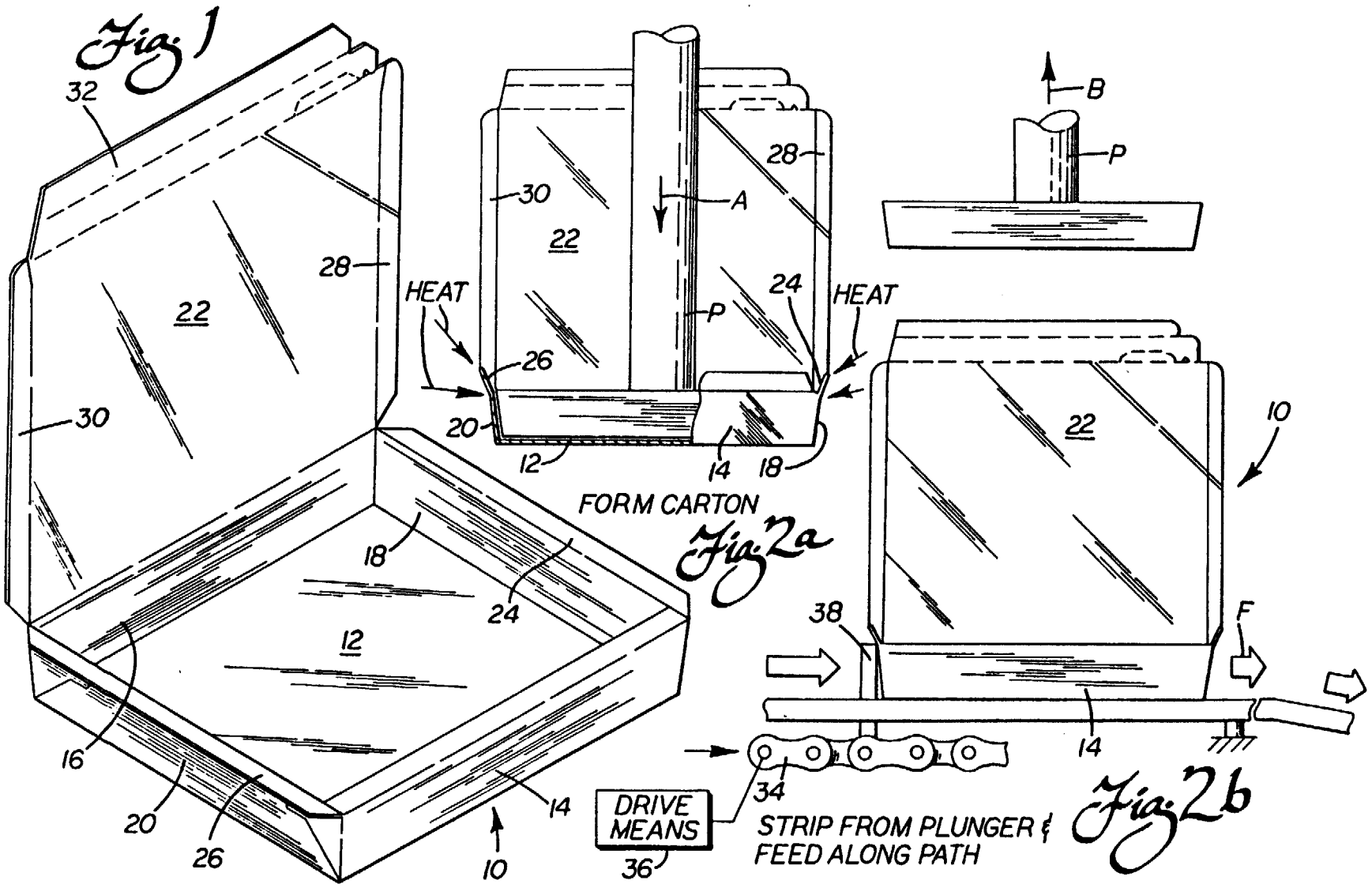
FIG. 1 is a perspective view of a multi-sided carton, having a body with side flanges and a hinged cover panel with side edge extensions, that is closed according to the method of and using the apparatus of the present invention.
FIG. 2*a* is a view of the plunger in a conventional carton forming machine (carton side broken away for clarity), illustrating the initial formation of a carton.
FIG. 2*b* is a side view showing the carton having been stripped from the plunger, shown in FIG. 2*a* and delivered to the takeaway conveyor for feeding along the feed path for filling and sealing.

Reference will now be made in detail to the present preferred embodiment of the invention, an example of which is illustrated in the accompanying drawing.

DETAILED DESCRIPTION OF THE DRAWING

The drawing figures illustrate the new and improved preferred method of closing an ovenable carton, and as carried out with the novel, preferred apparatus disclosed herein. The method represents a substantial improvement over prior art processes in several ways, including elimination of intermittent feed through the closing operation. Advantageously, the inventive method is easily integrated into an overall processing operation for packaging, allowing continuous movement all the way from the standard carton forming machine to the end of the packaging line. This facilitates the use of higher feed speeds and superior operating efficiency.

FIG. 1 shows a multi-sided carton 10 of the type that is to be closed by the inventive method. The carton 10 is exemplary of those used in the food industry that are made of paperboard and coated on one side (that is, on the internal product receiving surface) with a heat resistant coating. The closing method and the inventive apparatus used in its practice are especially adapted for cartons having any type of heat resistant coating; such as a thermosetting plastic, namely polyester resin. The coating is applied as a thin film (i.e. in the range of ¾–1½ mil, preferably approximately 1 mil) on the surface of the paperboard (see FIGS. 10*a*, 10*b* and 11). The thickness of the film varies according to particular carton uses.

The multi-sided carton 10 is typically formed from a blank with panels predefined by fold lines to assist in erection and forming. Once formed, the carton 10 generally includes a bottom panel 12 and side panels 14, 16, 18, 20. The bottom panel 12 and side panels 14–20 define a body that receives a product, such as a food item. The body of the carton 10 receives a cover 22 that is hermetically sealed thereto in accordance with the inventive method to confine and prevent spoilage of the product. While FIG. 1 illustrates a carton 10 whose cover 22 is a top panel hinged to the body, the method and related apparatus in their broadest aspects may be used with cartons in which the body is merged during the process with a separate lid.

In accordance with the method described below, the body of the carton 10 and the cover 22 are sealed together along corresponding peripheral edges. The body of the carton 10 includes side flanges 24, 26 attached to the top edge of the side panels 18, 20, respectively. The cover 22 includes side edge extensions 28, 30 that are disposed to mate with the side flanges 24, 26, respectively, for sealing.

The cover 22 for this exemplary carton 10 further includes a flap 32 that is sealingly attached to the panel 14 to form what is sometimes known in the art as the front of the carton. The inventive method and related apparatus are not directly concerned with closure and sealing of the flap 32. Rather this step is integrated with the improved closing method that provides the high integrity seal between the flanges of the carton body and the side edge extensions of the cover. It can be appreciated from the details below that the broad aspects of the closing method and the apparatus as broadly used in its practice are contemplated for sealing flanges on two, three or four sides of the carton body to corresponding side edge extensions on the cover.

FIGS. 2*a* and 2*b* generally present the aspects of the carton forming procedure that occur at the beginning of the processing line. As is known in the art, a scored blank is introduced into a substantially rectangular forming die (not shown). A vertically acting plunger P is caused to descend (see action arrow A in FIG. 2*a*), forcing the blank through the forming die. This creates the body of the multi-sided carton 10 defined by the bottom panel 12 and side panels 14–20. The side flanges 24, 26 remain in an upstanding position on the side panels 18, 20 as a result of the relative stiffness of the paperboard and film coating.

The side flanges 24, 26 may be preheated along the fold lines as the coated paperboard blank is introduced into the forming die. This advantageously can take place as the flat blank is positioned on top of the die, and/or as the carton is erected (see the heat representative arrows). Preheating in this manner assists in the flange bending process of the closing method, as more fully described below.

After the body of the carton 10 is formed, it is stripped from the plunger P as the latter is quickly retracted from the die (see action arrow B in FIG. 2*b*). The formed carton 10 is transferred to a takeaway conveyor 34 that delivers the carton 10 downstream to the bending apparatus used in the closing method. The takeaway conveyor 34 is propelled forwardly by a standard drive means 36. The conveyor 34 supports a series of spaced pushers 38 that engage and carry the carton 10 along the feed path. The flow arrows F are used in this figure throughout the following sequential figures, to indicate the course of the carton 10 through the processing system.

In order to best take advantage of the inventive closing method and related apparatus, the carton 10 is preferably carried along the feed path so as to present the upstanding leading flange 24 and the upstanding trailing flange 26 in the direction of travel. Thus, the carton 10 is fed sidewise to properly isolate the flanges 24, 26 for bending by the inventive bending apparatus.

FIGS. 3 through 5 broadly illustrate in succession some of the key aspects of the novel carton closing method. It is appreciated from the drawings and the following descriptive details that the carton 10 flows continuously along the feed path during the pre-breaking, bending, adhesive activation, product filling and sealing stages of the closing method. Accordingly, the closing method, and as carried out by the related apparatus, facilitates higher operating speeds and specifically eliminates the need to stop forward feed movement to prepare and/or seal the carton during processing.

As the carton 10 progresses along the takeaway conveyor 34, it is preferably picked up by an overhead conveyor 40 for delivery to the apparatus that executes the bending step of the closing method. The overhead conveyor 40 is preferably driven by a rotary drive 42.

Figures 3A, 3B, 3C:
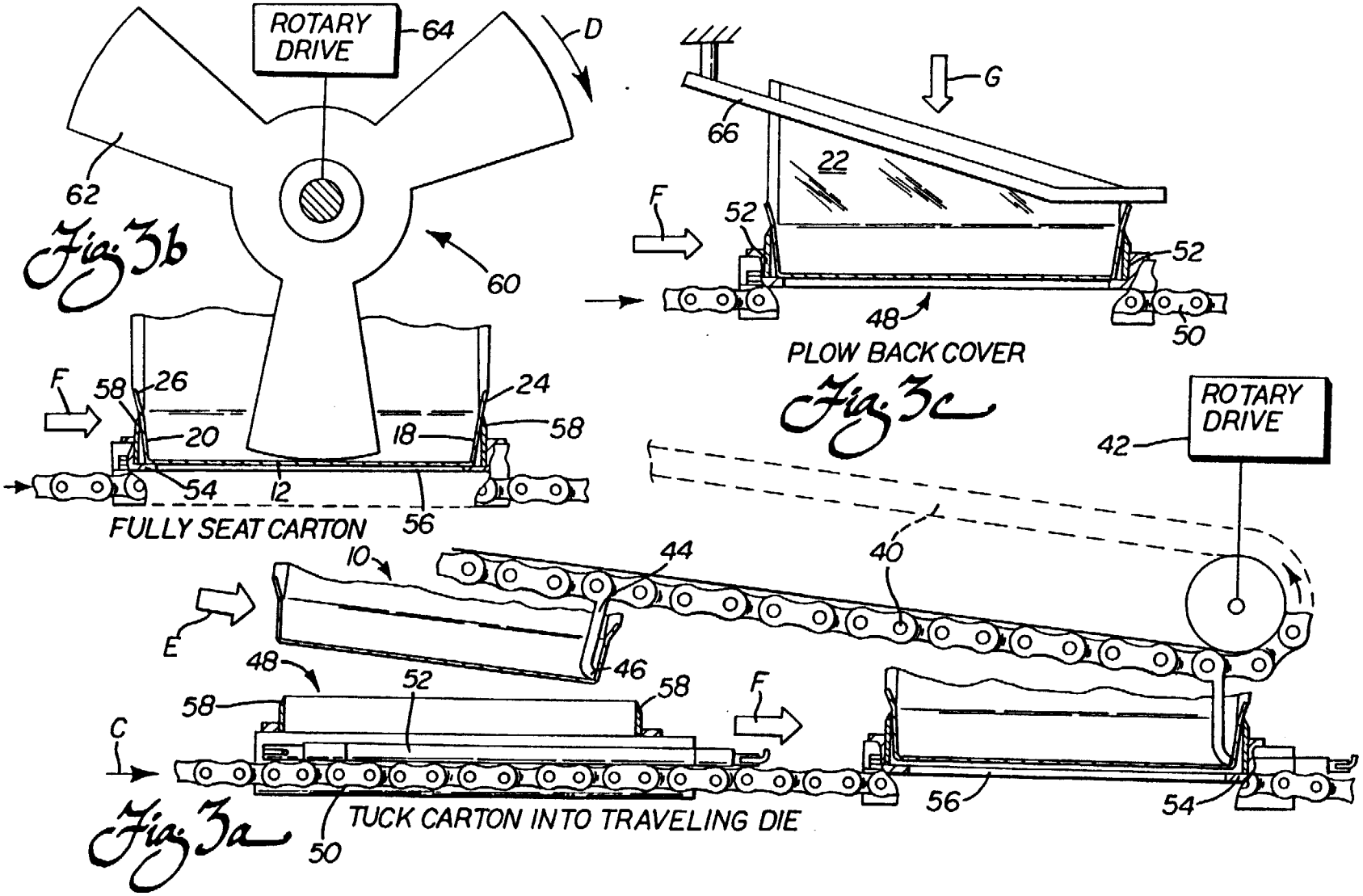
FIG. 3*a* is a side view showing the carton being transferred and tucked into the cavity of the travelling die.
FIG. 3*b* is a side view showing the operation of the positioning wheel to securely position the carton within the cavity of the die so that the forming blades are aligned with the fold lines between the carton and the side flanges.
FIG. 3*c* is a side view showing the use of a plow bar to force the hinged panel cover of the carton backwards to prevent its interference with the side flange bending operation of the closing method.
Figure 3A:
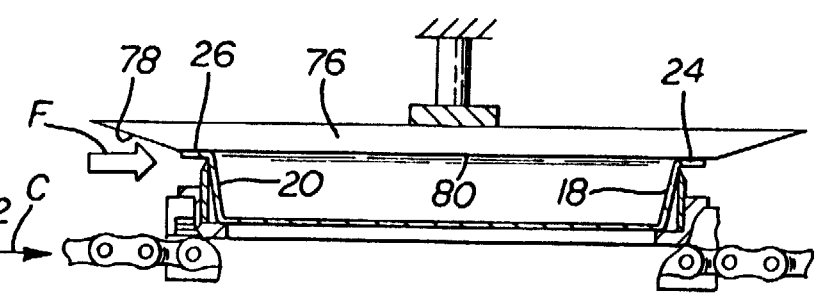
Figure 3B:
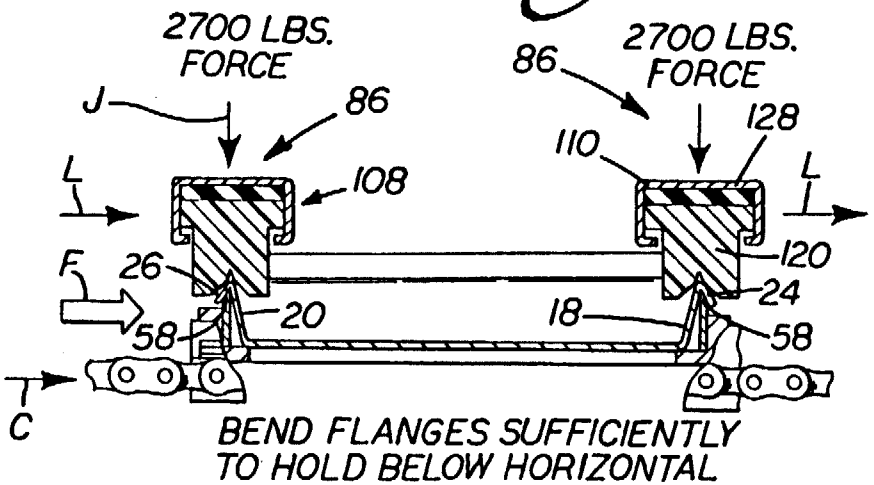
Figure 3D:
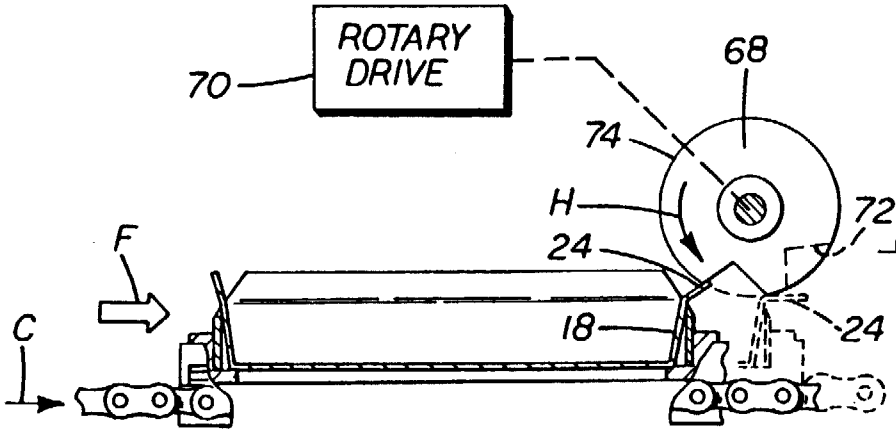
FIG. 3*d* is a side view showing the operation of the tucker wheel to pre-break the leading side flange of the carton body.
Figure 3A:
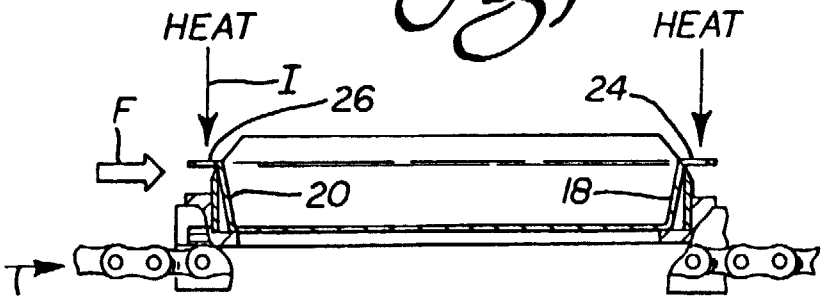

As shown in FIG. 3*a*, depending fingers 44 are spaced along the overhead conveyor 40. Each depending finger 44 has a forwardly directed tip 46 that assists in the transfer operation from the takeaway conveyor 34. More particularly, as the carton 10 approach overhead conveyor 40, the tip 46 of the depending finger 44 engages the leading side panel 18 to facilitate transfer of the carton to a travelling die 48 that forms a key part of the bending apparatus. The die 48 is generally rectangular in shape and dimensionally corresponds to the carton 10 being processed. A series of dies 48 are preferably supported on an endless die conveyor 50 with a forward run (shown in full line; note action arrows C in FIGS. 3*a*–4*c*) and a return run (shown in phantom in FIG. 3*a*).

Each die 48 is preferably formed with four sides 52, each side extending upward from a contiguous bottom frame 54 (see FIG. 6), which forms an open cavity 56 within the die 48. The open cavity 56 facilitates removal of the carton 10 from the die 48 as is more fully described below.

Figures 6, 7A, 7B, 7C:
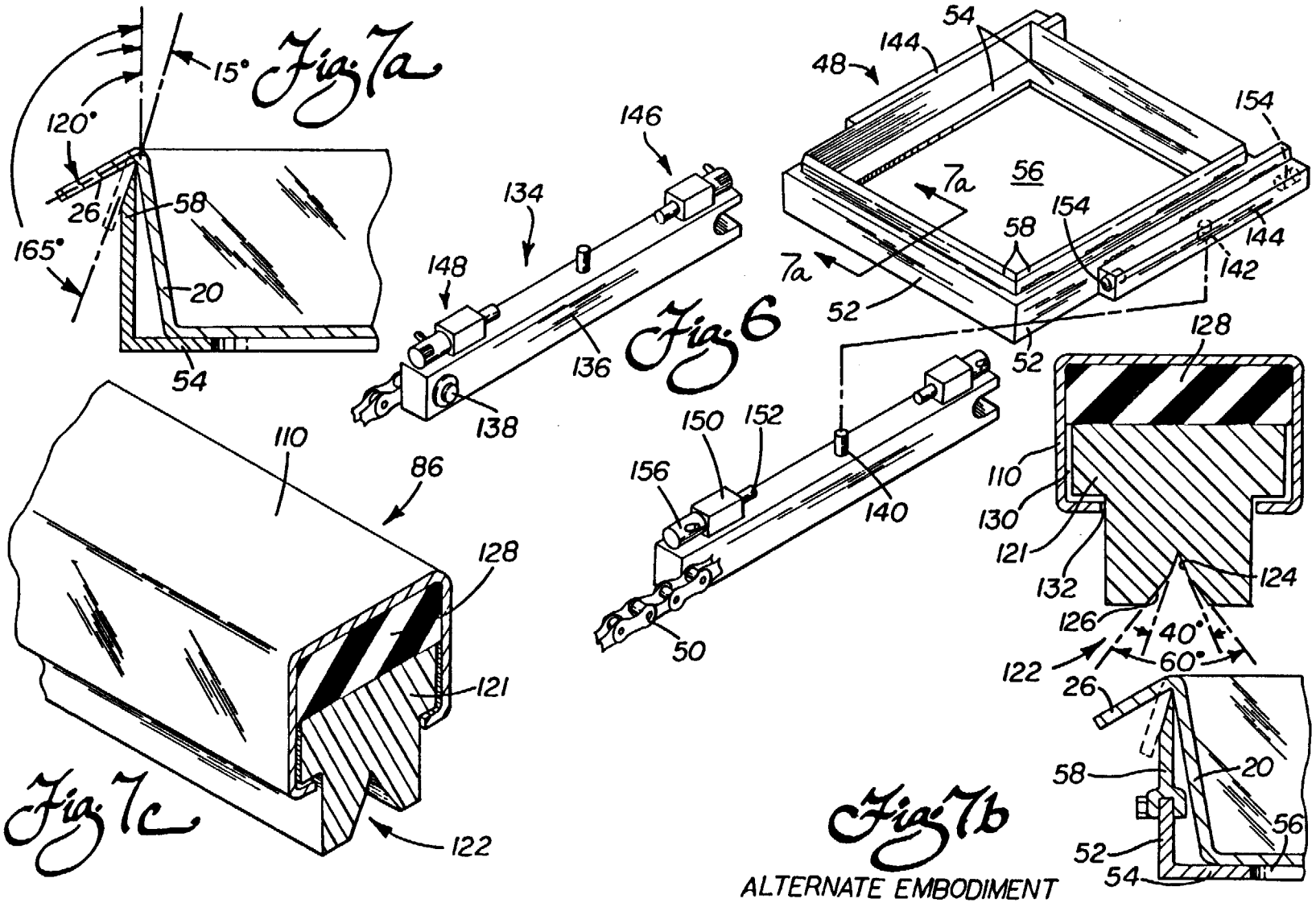
FIG. 6 is an exploded view of the die with its mounting cradle on the die conveyor.
FIG. 7*a* is an enlarged cross-sectional cut-away view of the die taken through lines 7*a*—7*a* in FIG. 6 and including a carton body therein, showing the side flange squeezed over the forming blade in phantom line and in its free downwardly bent position in full line.
FIG. 7*b* is a view similar to FIG. 7*a* showing an alternate embodiment of the die with a removable forming blade and further showing an enlarged cross-section of the transverse platen member with its bending groove or slot.
FIG. 7*c* is an enlarged cut-away perspective view in cross-section of the transverse platen member.
Figure 8:
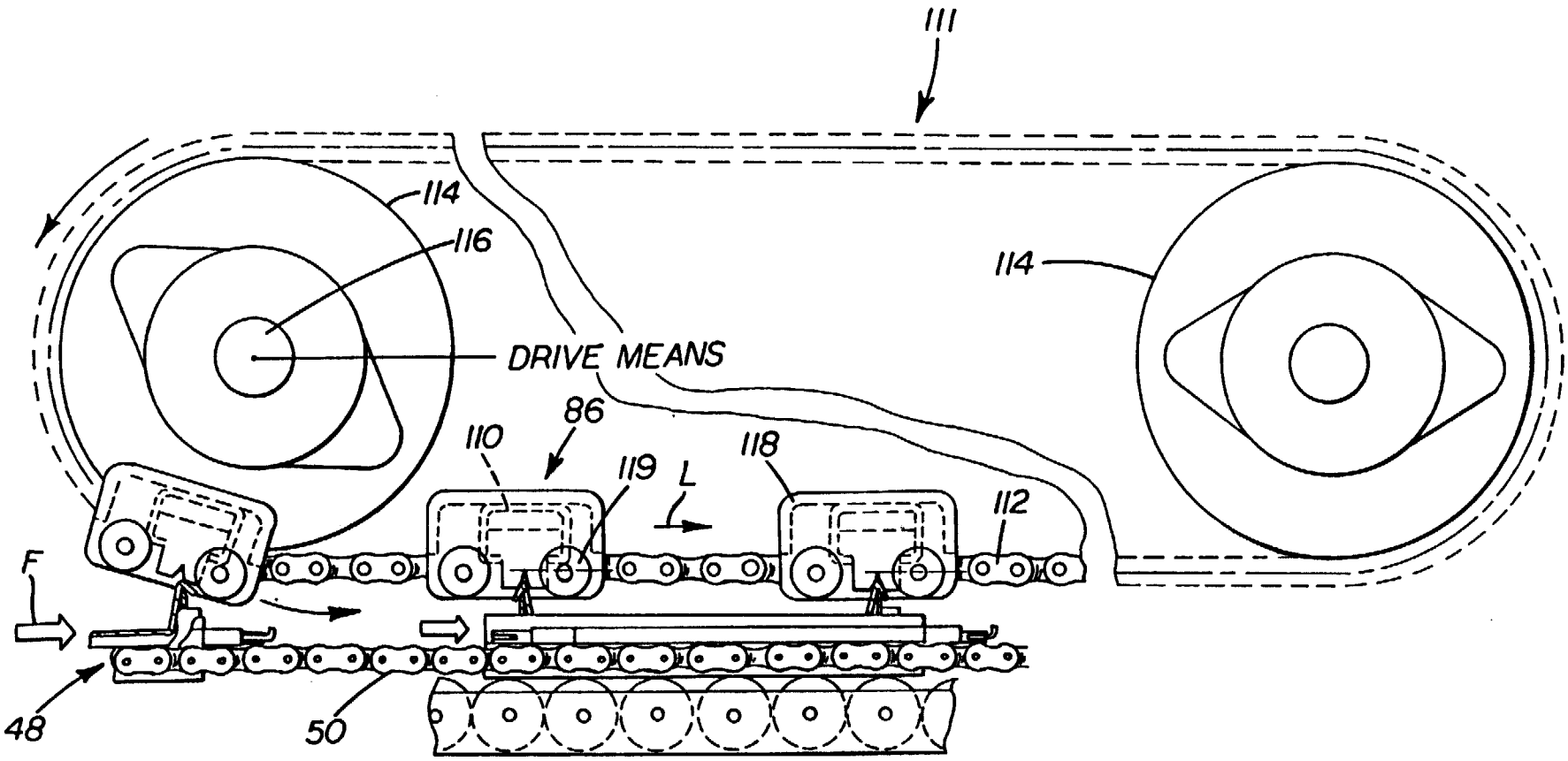
FIG. 8 is a cut-away side view showing two adjacent transverse platen members engaging and squeezing the side flanges of the carton body over the forming blades of the die during continuous travel.
Figure 9:
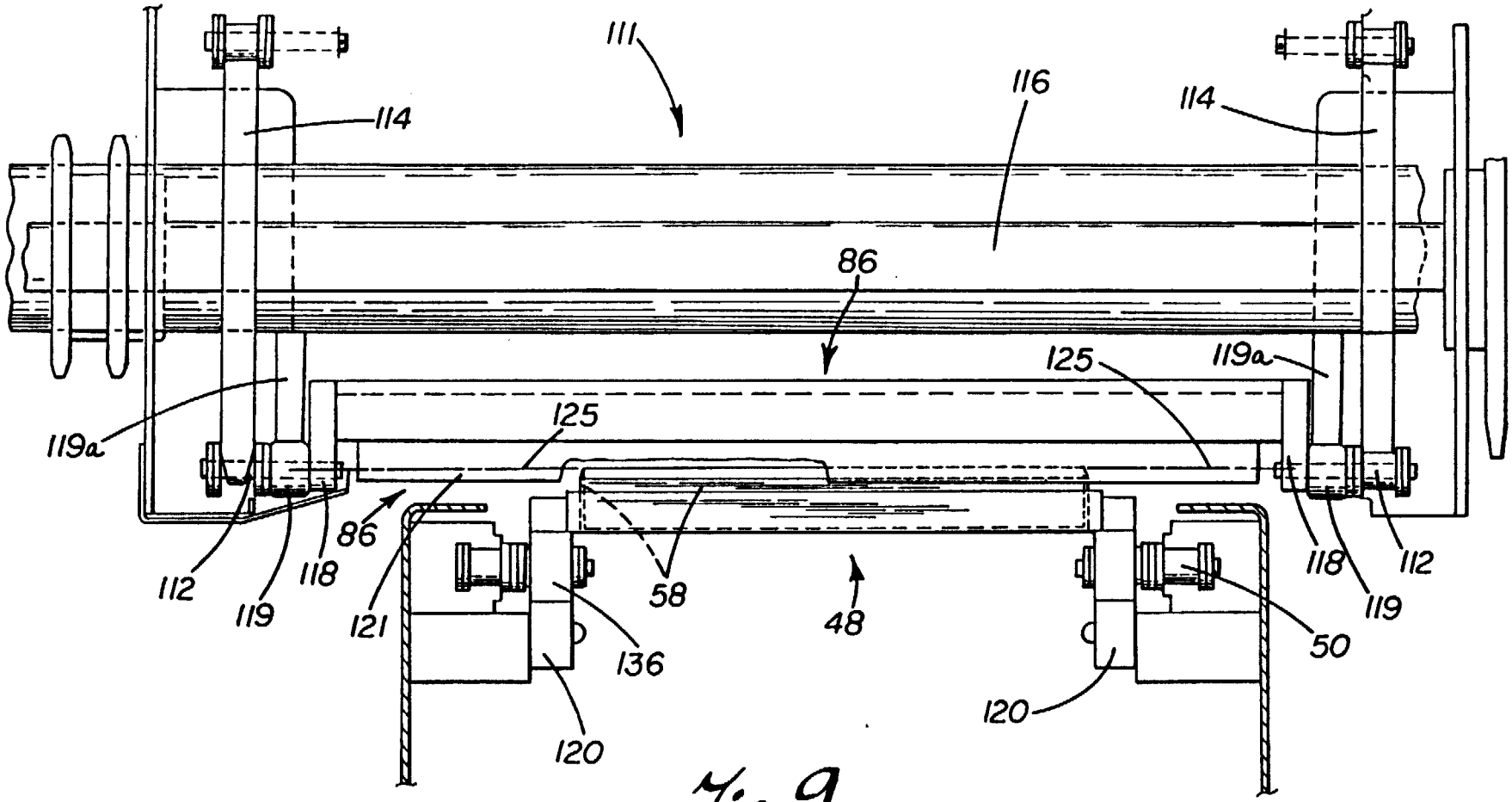
FIG. 9 is a cross-sectional view of the conveyor with the transverse platen member (partially broken away) in cooperative engagement with the die for bending.

In an important aspect of the novel bending apparatus, each side 52 of the die 48 includes a forming blade 58 (see FIG. 7*a*). The forming blades 58 cooperate with later described components of the bending apparatus to facilitate the bending of the carton side flanges 24, 26 during continuous feed movement. By providing forming blades 58 on each side 52 of the die 48, the bending apparatus is adapted to bend two, three or four flanges on a carton body in preparation for sealing. The die 48 can be provided with fewer forming blades (i.e. on only the leading and trailing edges) if desired. While the preferred embodiment of the die 48 is constructed with each forming blade 58 as an integral portion of its corresponding side 52, an alternate embodiment contemplates the use of separate replaceable blade elements on the die (see FIG. 7*b*).

In order to ensure its proper positioning within the die 48, the carton 10 is directed to merge with the die at a slight acute angle (see entry flow arrow E in FIG. 3*a*). Experimentation has shown that proper carton positioning most efficiently results from entry at an angle of approximately 6–10 degrees. Of course, the entry angle may be adjusted according to carton size.

In addition, the overhead conveyor 40 is driven at a speed that is slightly in excess of the feed speed of the die conveyor 50. Accordingly, the tip 46 of the depending finger 44 operates to urge the leading bottom corner of the carton 10 to a forward position within the die 48, thus tucking the carton securely therein.

While the overhead conveyor 40 efficiently positions the carton 10 within the die 48, it is necessary to ensure that the carton is fully seated therein. To promote the proper, full seating action of the carton 10, the die 48 travels past a downstream positioning wheel 60, preferably including a plurality of radial arms 62. The positioning wheel 60 is driven by a rotary drive 64 so as to rotate in a direction counter to the flow of the feed path (see action arrow D in FIG. 3*b*). The positioning wheel 60 is so situated to allow the radial arms 62 to avoid the sides 52 as they rotate across the die 48. The arms 62 engage the carton 10 with sufficient force to urge the trailing bottom corner firmly into engagement with the bottom frame 54 of the die 48.

The proper seating of the carton 10 in the die 48 is important to facilitate efficient bending of the side flanges 24, 26. More particularly, the carton 10 is positioned within the die 48 so that the forming blades 58 are aligned from below with the fold lines between the carton side panels 18, 20 and side flanges 24, 26, respectively. The forming blades 58 are thus precisely positioned so. that the flanges 24, 26 are bent and squeezed thereover.

When the carton 100 includes a hinged panel cover 22, it is important to prevent the cover from interfering with the bending of the side flanges 24, 26. In this situation, a restraining plow bar 66 is positioned upstream from the bending operation to restrain the cover 22. The plow bar 66 acts to urge the cover 22 backwards and away from above the body of the carton 10. Direction arrow G in FIG. 3*c* depicts the movement of the cover 22 backwards in preparation for downstream handling of the carton 10.

In order to further facilitate the bending process, it is beneficial to pre-break the flanges 24, 26 during travel along the feed path. The preferred embodiment of the bending apparatus includes a tucker wheel 68 that is specifically utilized to pre-break the leading flange 24. The tucker wheel 68 is driven to rotate in the feed direction (see action arrow H in FIG. 3*d*) by a rotary drive 70. The tucker wheel 68 includes a notch 72 that engages angity the tucker wheel 68 is synchronized with the forward velocity of the die conveyor 50 so that the upstanding leading flange 24 of a carton 10 moving along the feed path is always presented to the notch 72 as the die 48 travels past as shown in the full line position. As the flange 24 is flattened upon engagement with the circular peripheral surface 74 of the wheel 68 after exiting the notch 72 (note the phantom line position), the flange is broken along its fold line with the leading side panel 18.

The novel closing method also contemplates pre-breaking the upstanding trailing flange 26 as the carton 10 continues along the feed path in the die 48. More specifically, the die conveyor 50 travels past a stationary overhead guide 76. The overhead guide 76 has a first inclined portion 78 that transitions to a flat surface 80. As the die conveyor 50 passes the overhead guide 76, the leading flange 24 is held flat as it slides along and under the flat surface 80. The upstanding trailing flange 26 then contacts and is pre-broken to a horizontal position. The trailing flange 26 slides along and under the flat surface 80 to complete the flattening action. Both flanges tend to remain in a horizontal position after disengagement with the overhead guide 76.

Figure 10A:
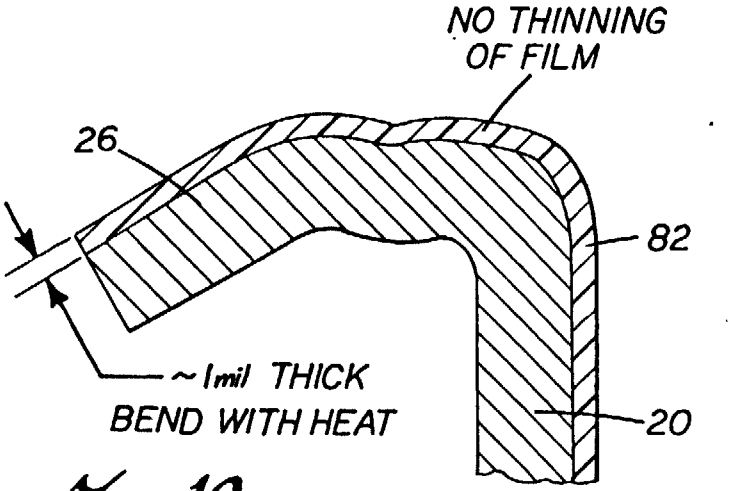
FIGS. 10*a* and 10*b* are enlarged cross-sectional cut-away views of the carton at the fold line between the body side panel and the side flange showing the response of the film coating following bending with and without the pre-application of heat, respectively.
Figure 10B:
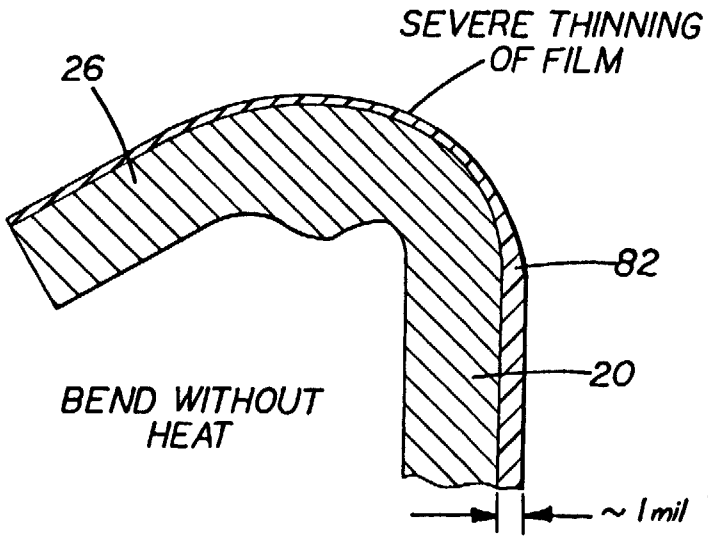

As described above, the bending process is significantly enhanced when the flanges 24, 26 are preheated. After the pre-breaking stage, heat is directed to the flanges 24, 26 as indicated by action arrows I in FIG. 4*a*. The purpose of preheating is best described with reference to FIGS. 10*a* and 10*b*. These enlarged views illustrate the area of the fold line between the side panel 20 and side flange 26 and show the heat resistant film coating 82 that is applied to the paperboard base. Research has shown that without the pre-application of heat, the film 82 stretches and thus thins significantly when the side flange 26 is bent, as is shown in FIG. 10*a*.

In contrast, the pre-application of heat dramatically improves the foldability of the flange 26 along the fold line. More particularly, the heat applied in the preheating step raises the surface temperature of the carton 10 adjacent the fold line sufficiently to swell the coating as it is softened. As a result, the film 82 is maintained at a substantially constant thickness as the bend at the fold line is made. By maintaining a constant thickness of the film 82 on the flange 26, the amount of mechanical stretching of the film is greatly reduced. This is especially important when a tough, thermosetting film, such as polyester, is being utilized.

Of course, as mentioned above, the preheating step can also be carried out in the forming machine. Since the carton 10 moves rapidly in this area, sufficient heat is retained when this approach is used. It has been found that the surface temperature of the carton 10 that results in the best preheating for bending a carton with polyester coating falls within the range of approximately 100°-250° F. Most preferably, the targeted temperature is approximately 110°.

Figure 11:
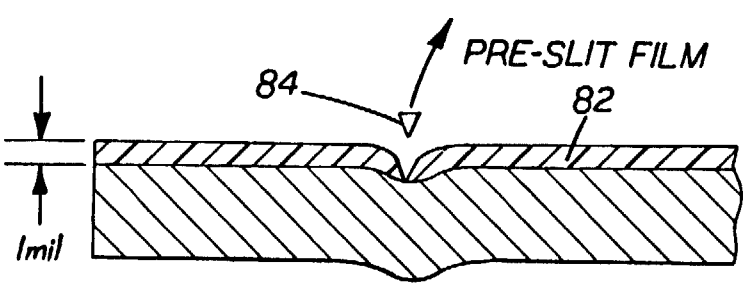
FIG. 11 is an enlarged cross-sectional cut-away view of the carton in blank form showing the action of pre-slitting the film coating at the fold line to facilitate bending.

The bending of the flanges 24, 26 may also be facilitated by pre-slitting the film coating 82 at the fold line at an upstream position from the bending operation. FIG. 11 schematically shows a knife element 84 as it is retracted after pre-slitting the film 82 through to the surface of the paperboard blank. The pre-slitting operation may be used in conjunction with the preheating of the flanges to maximize the efficiency of the bending operation.

With the flanges 24, 26 properly preheated, the die 48 carrying the carton 10 proceeds to complete the bending operation, as illustrated in FIG. 4*b*. A bending element or platen member, generally designated by numeral 86, is forced down upon the forming blade 58 of the die 48 (see action arrow J). In so doing, the flanges 24, 26 are bent over and squeezed against the edges of the forming blades 58. The force applied is sufficient to cause the flanges 24, 26 to fold and remain free below the plane of the fold lines after the bending element 86 is released. It has been found that the necessary bending force to overcome the stiffness and inherent memory of the paperboard and plastic coating falls within a range of 90 pounds/inch of fold to 550 pounds/inch. The force needed may vary according to several additional parameters, including the speed of operation and/or the time during which the force is applied. In the preferred embodiment shown, a bending force of 2,700 pounds applied to a 5.75 inch fold line of a polyester coated carton provides a figure of approximately 470 pounds/inch.

A key feature of the bending element 86 is its mounting for travel in concert with the die 48 (cf. action arrows F and L). This is critical to performing the flange bending operation during continuous feed movement. The specific details of the bending element 86 and its mounting for movement with the travelling die 48 are more fully described below.

After the carton 10 is released from the bending element 86, it is removed from the die 48 and directed downstream for filling and sealing. As shown in FIG. 4*c*, this releasing function is accomplished by a lift means 88 that operates through the open cavity 56. Preferably, a lifter 90 is synchronously operated to pass upwards through the cavity 56 to engage the bottom panel 12 of the carton 10. A lug depending from an overhead conveyor (not shown) travelling in the direction of the feed path engages and directs the carton 10 to a downstream conveyor 92 that transports the carton to the filling station. A product charge, such as a ready-to-eat food item, is delivered to the carton 10 as it passes in continuous fashion through the filling station.

After the carton 10 is filled with product, it continues along the feed path to the sealing station. The carton 10 is carried along the conveyor 92 by flights 94 mounted for movement therealong. For cartons 10 with a hinged panel cover 22, the feed path includes a closing plow bar 96 that urges the cover 22 through an upstanding position, and then downwardly as indicated by direction arrow M (see FIG. 5*a*). The cover 22 is ultimately plowed to a closing position covering the open top of the carton 10. It is at this point with this particular type of carton 10 that the flap 32 is sealed to the panel 14.

Once the flap 32 is sealed to the panel 14, the carton 10 is rotated 90 degrees. Thus, the side flanges 24, 26 now face in a direction perpendicular to the direction of the initial feed path (see FIG. 5*b*). The carton 10 passes an adhesive activation station where heat is applied to activate the film coating in preparation for sealing.

Figures 5A, 5B, 5C, 21C:
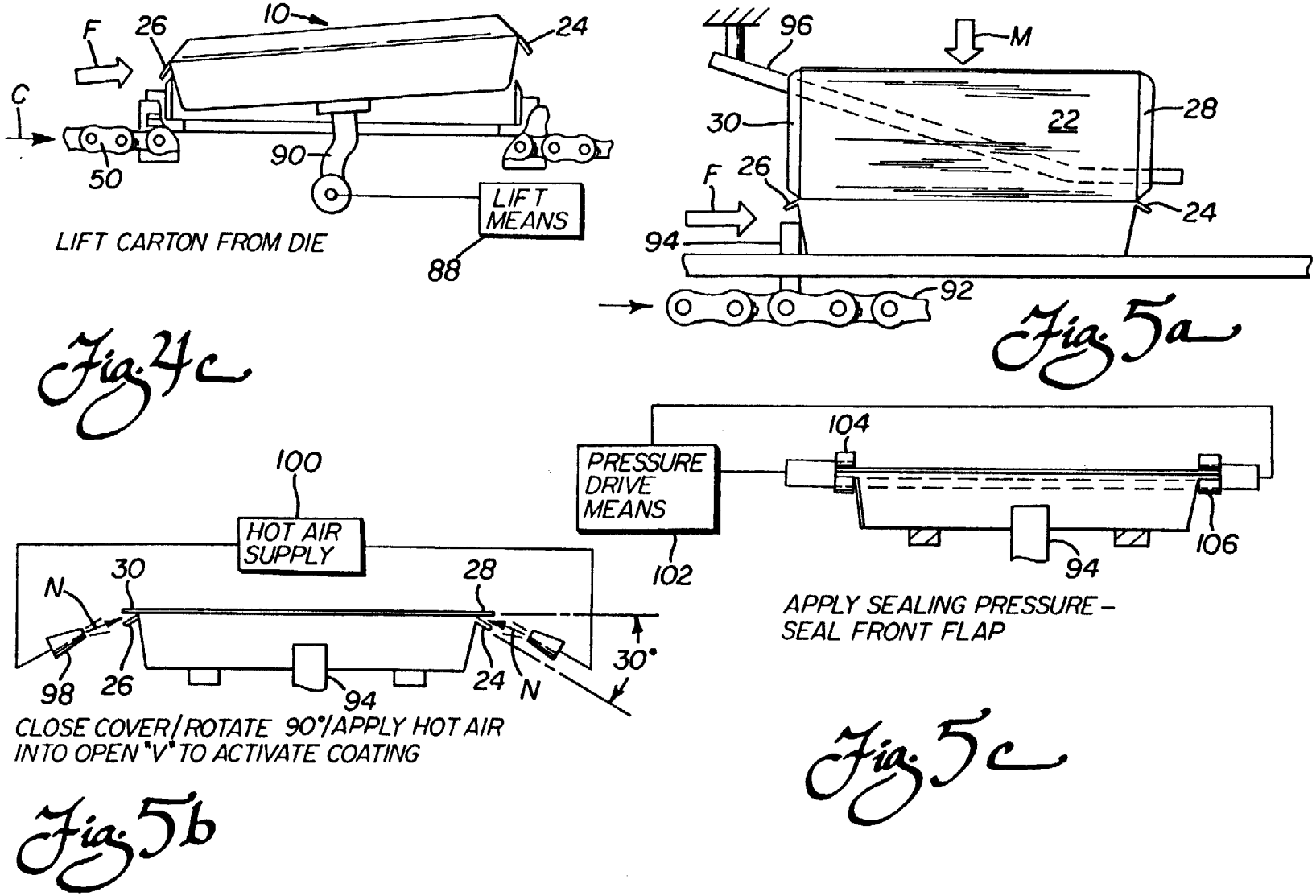
FIG. 5*a* is a side view of the carton continuing along the feed path after being charged with product, showing a plow bar forcing the hinged panel cover forward to cover the body in preparation for the sealing operation.
FIG. 5*b* is a trailing view showing the carton after the cover is in position and a hot air stream is being blown into the half-V gaps formed between the bent side flanges of the carton body and the side edge extensions of the cover to activate the film coating for sealing.
FIG. 5*c* is also a trailing view showing the application of pressure to seal the side flanges of the carton body and the side edge extensions of the cover together.

Specifically, as illustrated in FIG. 5*b*, the cover 22 is now disposed in its proper horizontal position over the body of the carton 10. The flanges 24, 26 remain bent below the plane defined by the flange fold line and the horizontally disposed cover 22. The side edge extensions 28, 30 of the cover 22 overlie the bent side flanges 24, 26. Accordingly, as shown, a gap in the form of a half-V exists. The gap is defined by an angle of substantially 30 degrees.

Flow nozzles 98 on opposing sides of the conveyor 92 direct a stream of hot air from a hot air supply 100 into the half-V gap, as indicated by action arrows N. Preferably, the carton 10 is delivered to this station with its side flanges 24, 26 at a residual temperature of approximately 75°-85° F. Sufficient heat is applied to cause the film coating on the opposing surfaces of the flanges 24, 26 and side edge extensions 28, 30 to become tacky. The hot air activation of the film coating advantageously occurs during continuous movement of the carton 10 along the feed path. It is appreciated that the efficiency of the bending process obviates the need to hold the gap between each carton flange 24, 26 and its opposing cover side edge extension 28, 30 open during the application of the hot air stream.

The carton 10 proceeds along the feed path to a sealing station where sealing pressure is applied to bond the opposing side flange/side edge extension pairs together as shown in FIG. 5*c*. Preferably, a pressure drive means 102 actuates opposing upper and lower roller presses 104, 106, respectively, to press the opposing side flanges 24, 26 and side edge extensions 28, 30 together, and thus form the high integrity heat seal between the cover 22 and carton body. When the heat seal is properly established, the temperature of the flange area of the carton is preferably in the range of 125°-137° F. when leaving the heating station. The sealed carton 10 is then delivered to the end of the packaging line for fast freezing, storage and eventually shipment.

FIGS. 6-9 depict several of the important aspects of the inventive bending apparatus that is used to practice the novel closing method just described. A plurality of the bending elements or platen members 86 (see FIG. 7*c*) are mounted by integral elongated carriers 110 and supported in series on an overhead conveyor system 111, disposed above the die conveyor 50 (see FIGS. 8 and 9). In the preferred embodiment, the overhead conveyor 111 is shown as a pair of roller chains 112 each trained around opposing sprocket wheels 114. The sprocket wheels 114 are driven as is customary by a drive means, such as a drive shaft 116. The platen members 86 are fixed at both ends to a carriage bracket 118. The bracket 118 is attached to and thus mounts the platen members 86 to the inside of roller chains 112.

The overhead conveyor 111 is synchronously driven for movement with the die conveyor 50. The platen members 86 are longitudinally spaced so as to cooperatively engage the leading and trailing edges of the die 48 along substantially the full run of forward travel of the platen members (see FIG. 8). Accordingly, there is sufficient time to apply the appropriate force to bend the flanges 24, 26 so they remain in a downwardly bent position following release from engagement.

The platen members 86 advantageously are positioned to correspond to the pitch point of the chains 112, as will be further discussed below. This allows the platen members 86 to smoothly receive the fold lines between the carton side panels 18, 20 and side flanges 24, 26 during both engagement and disengagement therebetween (see particularly leftmost platen member 86 preparing to engage the leading edge of the die 48 in FIG. 8).

The bending apparatus further includes means for providing forced, relative movement of the die 48 and the platen members 86 toward each other to provide the required force to facilitate bending of the flanges 24, 26. The amount of force required to bend the flanges 24, 26 of a standard carton 10 with 5-6 inch sides is in the range of 500-3,000 pounds. Preferably, the amount of force applied is approximately 2,700 pounds for a 5¼ inches wide fold. Pneumatic cylinders may be provided as part of the overhead conveyor system 111 to resiliently force the platen members 86 downwardly relative to the edges of the die 48 when in the proper position for bending. It can be appreciated that interacting guide rollers 119 on the carriage brackets 118 and cooperating rails 119*a* are used to provide the downward holding force for the platen members 86; and stationary support side rollers 120 below the dies 48 provide the opposite or upward holding force (see FIG. 9).

As shown in FIGS. 7*b* and 7*c*, the preferred embodiment of the platen member 86 includes a plastic (i.e. cast nylon) block 121 having a downwardly directed V-shaped groove 122. The groove 122 receives the carton fold; that is, the flange and side panel (shown here as the cooperating trailing pair 26 and 20), to provide the bending and squeezing action. The groove 122 includes an apex section 124 that directly engages the fold line between the flange 26 and the side panel 20. In the preferred embodiment, the apex section 124 is formed with an included angle of 40 degrees. The apex is aligned with the pitch point of the side running chains 112 (note line 125 in FIG. 9).

The groove 122 is further provided with a lead section 126 designed to guide the fold of the carton into the apex section 124 for bending. The lead section is preferably formed with an included angle that is slightly larger than the angle of the apex section 124. The preferred embodiment illustrated in FIG. 7*b* presents the lead section 126 as having an included angle of 60 degrees. This geometry coupled with the groove apex alignment with the pitch point of the chain 112 provides for smooth entry and exit of the carton fold with respect to the groove 122.

In order to provide additional resilient squeezing action and accommodate slight misalignment between the platen member 86 and the blade 58 of the die 48 upon engagement, the platen member is designed to float within its carrier 110. More particularly, the plastic block 121 is mounted on an elastomeric pad 128 that is bonded to the carrier 110. The resilient pressing action of the platen member 86 during the bending operation also prevents damage to the parts of the mechanism in the event of a carton jam or misfeed, wherein more than a single fold is caught in the groove 122. However, clearance is provided between the plastic block 121 and the carrier 110, as indicated by side margins 130 and 132 in FIG. 7*b*. These resilient mounting features and clearance allow for the necessary passive adjustment to ensure precisely aligned engagement of the carton fold within the apex 124 of the groove 122. Thus, the possibility of a carton jam during the bending operation is actually substantially eliminated.

FIG. 7*a* particularly illustrates the relative position of the flange 26 during and after the bending action. The forming blade 58 of the die 48 is preferably formed with an edge inclined at 15 degrees. Thus, when the platen member 86 engages the blade edge for bending and squeezing, as illustrated in the phantom line position of the flange 26, the flange is bent downwardly to a position of approximately 165 degrees from a referenced vertical position. With sufficient pressure applied in this position, the flange 26 remains at a position 120 degrees from the referenced position when the platen member 86 is disengaged. This free, downwardly bent position provides the 30-degree gap between the flange 26 and the side edge extension 30 of the cover 22, as illustrated in FIG. 5*b*. As mentioned above, the hot air can thus efficiently enter the half-V gap and fully activate the film coating on the opposing surfaces to facilitate adhesive sealing.

The die 48 is held by a mounting cradle 134, as shown in FIG. 6. The cradle 134 comprises a pair of side rails 136 that are attached to opposing chains of the conveyor 50 by an appropriate connector 138. The rails 136 each have a locating peg 140 that is received in a locating bore 142 formed in a side arm 144 of the die 48.

The die 48 is locked to the cradle 134 with front and rear latches 146, 148, respectively, on each of the cradle side rails 136. Each latch 146, 148 comprises a mounting block 150 that is fixed to the side rail 136. The mounting block 150 receives a rod 152 that is axially slidable in a hole in the mounting block. Each rod 152 is insertable in an aperture 154 in the end of the die side support arm 144. The rod 152 includes a handle 156 which may be grasped and rotated to facilitate the axial withdrawal and locking in a retracted position for removal of the die.

When mounting the die 48 on the cradle 134, the rods 152 are retracted and locked in position so that the locating bores 142 of the side arms 144 may be guided onto the locating pegs 140. The rods 152 are then unlocked and extended into the apertures 154 in the ends of the side arms 144. The die 48 is now secured and locked in position for use. This ensures adequate control and tracking of the carton 10 along the feed path through the bending operation.

In summary, numerous benefits result from employing the novel method disclosed herein for closing a heat resistant multi-sided carton 10. The continuous travelling die 48 has forming blades 58 to engage and squeeze the fold formed by the side flanges 24, 26 and the side panels 18, 20 against a platen member 86. This provides a highly efficient bending action resulting in a half-V gap being formed between each of the downwardly bent flanges 24, 26 and each of the corresponding side edge extensions 28, 30 of the carton cover 22. A hot air stream is directed into the gap to activate the coating on opposing surfaces to effect the adhesive seal upon the application of sealing pressure. The need to hold open the gaps between the flanges 24, 26 and the corresponding side edge extensions 28, 30 during hot air activation or during further movement is eliminated. The closing operation utilizing these and other inventive concepts thus advantageously allows the sealing of cartons during continuous forward feed movement, thereby improving the speed and efficiency of the overall processing operation.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, in handling cartons with three or four flanges for sealing, longitudinally disposed platen member(s) may be incorporated into the bending apparatus to co-act with the transverse platen members to bend the additional flange(s) during continuous movement. The embodiment herein was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed is:

1. A continuous closing method including sealing a cover with side edge extensions on a paperboard carton with corresponding side flanges defined by fold lines on the body comprising the steps of:

feeding the carton continuously and sideways along a path to present a leading upstanding flange and a trailing upstanding flange in the direction of travel;

bending the flanges downward during the continuous feed movement while said flanges are leading and trailing with a force sufficient to cause the flanges to fold and, when released, to remain free and below a plane passing through the fold lines for a predetermined time;

placing the cover on the carton so as to lie substantially in said plane and with the edge extensions overlying said flanges;

activating adhesive within said predetermined time while the flanges remain free in the at least half-V formed between the flanges and the cover;

said predetermined time being sufficient to allow full adhesive activation; and pressing said flanges against said cover for sealing after the adhesive activation;

whereby efficient sealing of the flanges occurs during continuous feed movement and while the flanges remain free during adhesive activation.

2. The method of claim 1, wherein the step of bending the flanges includes engaging the fold lines from below by forming blades and mating V-shaped platen members from above.

3. The method of claim 2, wherein the bending step includes applying approximately 500–3,000 pounds of force along each fold line.

4. The method of claim 1, wherein is provided prebreaking of the flanges along the fold lines and holding the pre-broken flanges in position only just prior to the bending step.

5. The method of claim 1, wherein is provided the step of preheating said flanges adjacent said fold lines to improve foldability.

6. The method of claim 5, wherein is provided the step of forming the carton; and said preheating step is provided upstream of the bending step and during forming of the carton.

7. The method of claim 5, wherein said preheating step is provided immediately upstream of the bending step.

8. The method of claim 1, wherein the feeding step includes carrying the carton in the cavity of a die including forming blades for bending the flanges and releasing the carton prior to placing the cover on the carton.

9. The method of claim 8, wherein the feeding step includes merging the carton with the cavity at an acute angle at the beginning of the feed path and tucking the carton into the cavity by urging the leading bottom corner at a speed slightly in excess of the feed speed.

10. The method of claim 9, wherein merging takes place at an angle of approximately 6–10 degrees.

11. The method of claim 9, wherein the feeding step further includes seating said carton firmly in the cavity of said die upstream of said bending step along said path.

12. A continuous closing method including sealing a cover with side edge extensions on a paperboard carton with corresponding side flanges defined by fold lines on the body and the interior coated with heat resistant material comprising the steps of:

feeding the carton continuously along a path with said side flanges upstanding;

bending the flanges downward during the continuous feed movement with a force sufficient to cause the flanges to fold and, when released, to remain free and below a plane passing through the fold lines;

placing the cover on the carton so as to lie substantially in said plane and with the edge extensions overlying said flanges;

activating adhesive within said predetermined time while the flanges remain free in the at least half-V formed between the flanges and the cover;

said predetermined time being sufficient to allow full adhesive activation; and pressing said flanges against said cover for sealing after the adhesive activation;

whereby efficient sealing of the flanges occurs during continuous feed movement and while the flanges remain free during adhesive activation.

13. The method of claim 12, wherein is provided the step of preheating said flanges adjacent said fold lines to improve foldability.

14. The method of claim 13, wherein sufficient heat is provided to raise the surface temperature of the carton adjacent said fold lines to maintain the temperature during bending above a level to substantially prevent thinning of said heat resistant coating as it stretches around said fold line.

15. The method of claim 14, wherein the surface temperature of said carton is held at a level below which the heat resistant coating becomes tacky.

16. The method of claim 15, wherein said surface temperature is approximately 100°–250° F.

17. The method of claim 12, wherein said feeding of the carton along the path is with the side flanges leading and trailing, and said bending is provided by applying approximately 500–3,000 pounds of force along each fold line.

18. The method of claim 12, wherein said flanges bend through an angle of approximately 135 degrees from the upstanding position and hold in the free state during adhesive activation at an angle of approximately 120 degrees.

19. The method of claim 12, wherein is provided the additional step of at least partially pre-slitting the heat resistant coating along said fold lines before bending.

20. The method of claim 12, wherein said heating resistant coating is approximately ¾–1½ mil thick.

21. The method of claim 12, wherein the step of placing said cover on the carton is provided by plowing a hinged cover on the body of said carton into position substantially in said plane.

22. The method of claim 12, wherein said adhesive activating step is provided by blowing hot air into the half-V.

* * * * *